US009190710B2

(12) United States Patent
Mao

(10) Patent No.: US 9,190,710 B2
(45) Date of Patent: Nov. 17, 2015

(54) ELECTRONIC DEVICE AND ANTENNA MODULE THEREOF

(71) Applicant: RICHWAVE TECHNOLOGY CORP., Taipei (TW)

(72) Inventor: Shau-Gang Mao, Taipei (TW)

(73) Assignee: RichWave Technology Corp., NeiHu District, Taipei (TW)

( * ) Notice: Subject to any disclaimer, the term of this patent is extended or adjusted under 35 U.S.C. 154(b) by 378 days.

(21) Appl. No.: 13/675,369

(22) Filed: Nov. 13, 2012

(65) Prior Publication Data

US 2013/0147669 A1 Jun. 13, 2013

(30) Foreign Application Priority Data

Dec. 9, 2011 (TW) ..... 100145515 A

(51) Int. Cl.

| | |
|---|---|
| ***H01Q 1/24*** | (2006.01) |
| ***H01Q 1/52*** | (2006.01) |
| ***H01Q 9/04*** | (2006.01) |
| ***H01Q 9/42*** | (2006.01) |

(52) U.S. Cl.

CPC ..... *H01Q 1/24* (2013.01); *H01Q 1/243* (2013.01); *H01Q 1/526* (2013.01); *H01Q 9/0414* (2013.01); *H01Q 9/42* (2013.01)

(58) Field of Classification Search

CPC ..... H01Q 1/24; H01Q 1/42
USPC ..... 343/702, 872
See application file for complete search history.

(56) References Cited

U.S. PATENT DOCUMENTS

| | | | | |
|---|---|---|---|---|
| 2009/0115669 | A1* | 5/2009 | Cheng | 343/702 |
| 2009/0256757 | A1* | 10/2009 | Chiang et al. | 343/702 |
| 2010/0090906 | A1* | 4/2010 | McGuire | 343/702 |
| 2010/0123632 | A1* | 5/2010 | Hill et al. | 343/702 |
| 2011/0037657 | A1 | 2/2011 | Yang | |
| 2011/0063180 | A1* | 3/2011 | Su | 343/795 |

FOREIGN PATENT DOCUMENTS

| | | |
|---|---|---|
| CN | 1323077 | 11/2001 |
| CN | 101997169 | 3/2011 |
| TW | M416947 | 7/2011 |

OTHER PUBLICATIONS

Chinese language office action dated Oct. 21, 2014.
English language translation of abstract of CN 101997169 (published Mar. 30, 2011).
Taiwanese language office action dated Mar. 20, 2015, issued in application No. 100145515.

* cited by examiner

*Primary Examiner* — Dameon E Levi
*Assistant Examiner* — Collin Dawkins
(74) *Attorney, Agent, or Firm* — Winston Hsu; Scott Margo

(57) ABSTRACT

An antenna module in provided. The antenna module includes a metal housing, a radiator and a feed conductor. The metal housing includes a housing surface and a through hole. The radiator surrounds the metal housing. The feed conductor connects the radiator to an inner circuit inside the metal housing via the through hole.

8 Claims, 3 Drawing Sheets

ELECTRONIC DEVICE AND ANTENNA MODULE THEREOF

CROSS REFERENCE TO RELATED APPLICATIONS

This Application claims priority of Taiwan Patent Application No. 100145515, filed on Dec. 9, 2011, the entirety of which is incorporated by reference herein.

BACKGROUND OF THE INVENTION

1. Field of the Invention

The present invention relates to an antenna module, and in particular relates to an antenna module with improved transmission.

2. Description of the Related Art

Conventionally, a planar inverted F antenna (PIFA) is widely utilized in various electronic devices, particularly portable electronic devices such as cell phones or tablet personal computers. However, with increased transmission requirement, portable electronic device need to transmit signals of GSM850/900/1800/1900/UMTS standards, wherein GSM means Global System for Mobile Communications and UMTS means Universal Mobil Telecommunications System.

A conventional planar inverted F antenna (PIFA) cannot satisfy more exacting transmission requirements.

BRIEF SUMMARY OF THE INVENTION

An antenna module in provided. The antenna module includes a metal housing, a radiator and a feed conductor. The metal housing includes a housing surface and a through hole. The radiator surrounds the metal housing. The feed conductor connects the radiator to an inner circuit inside the metal housing via the through hole.

The embodiment of the invention also provides an electronic device including a device housing, a control interface, a circuit board, and the antenna module mentioned above. The control interface is disposed on the device housing. The circuit board is disposed in the device housing. The antenna module is disposed in the device housing and located on the circuit board.

The embodiment of the invention provides an antenna module with a simple structure, quasi-isotropic radiation pattern, increased gain in a predetermined direction, and an improved traveling wave radiating mechanism.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
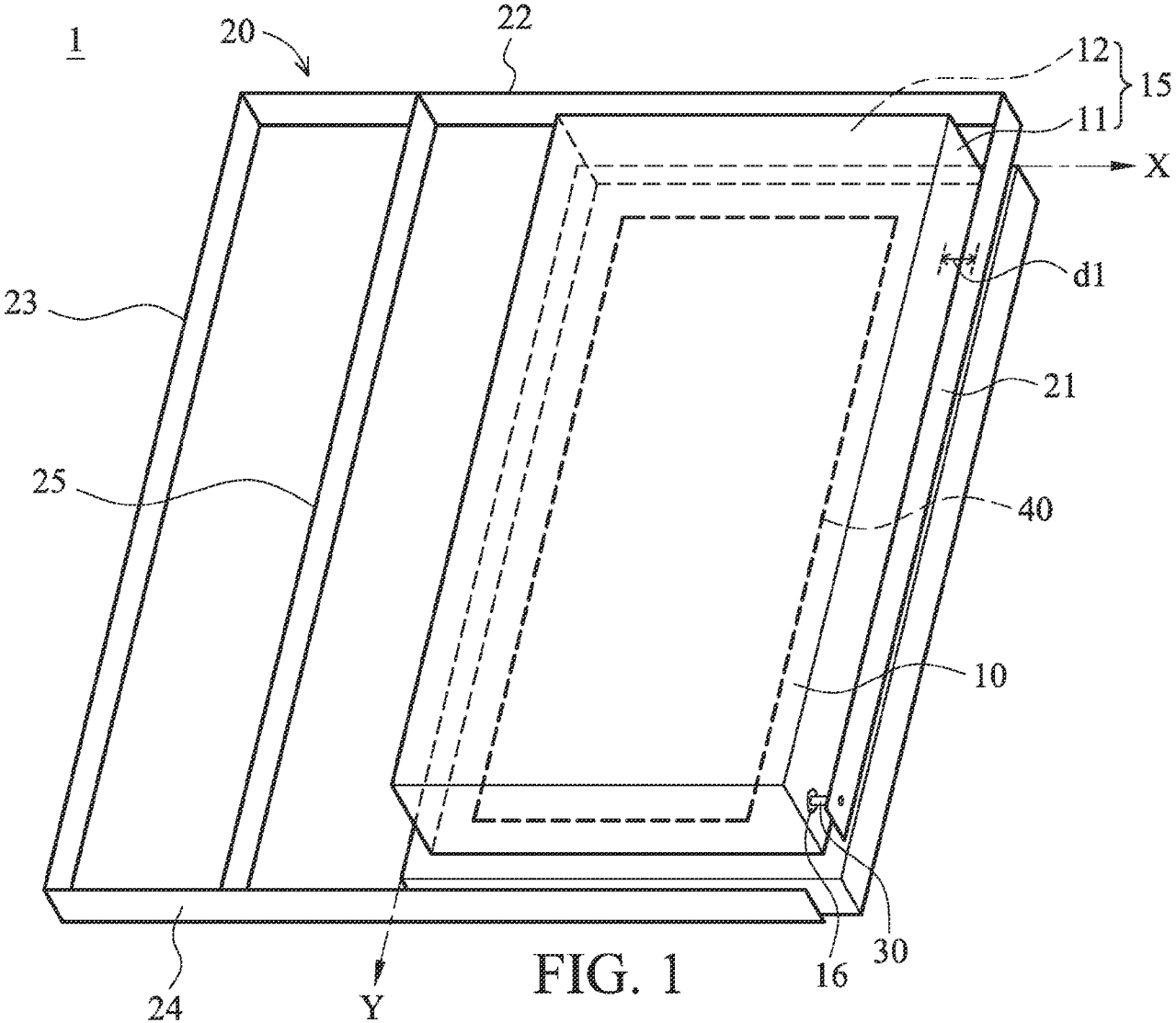
FIG. 1 shows an antenna module of an embodiment of the invention.

FIG. 1 shows an antenna module 1 of an embodiment of the invention, including a metal housing 10, a radiator 20 and a feed conductor 30. The metal housing 10 includes a housing surface 15 and a through hole 16. The radiator 20 surrounds the metal housing 10. The feed conductor 30 connects an inner circuit 40 inside the metal housing 10 to the radiator 20 via the through hole 16.

The radiator 20 includes a first section 21, a second section 22, a third section 23, a fourth section 24 and the fifth section 25. The first section 21 is connected to an end of the second section 22. The third section 23 is connected to the other end of the second section 22. The second section 22 is perpendicular to the first section 21, and is perpendicular to the third section 23. The first section 21 is parallel to the third section 23. The fourth section 24 is connected to an end of the third section 23, and the fourth section is perpendicular to the third section 23. An end of the fifth section 25 is connected to the second section 22. The other end of the fifth section 25 is connected to the fourth section 24. The fifth section 25 is located between the third section 23 and the metal housing 10.

The feed conductor 30 is connected to an end of the first section 21, and the second section 22 is connected to the other end of the first section 21.

The first section 21, the second section 22 and the third section 23 form a U-shaped structure.

The first section 21 and the second section 22 extend along a housing surface 15 of the metal housing 10. The first section 21 and the second section 22 are kept a distance away from the housing surface 15 of the metal housing 10.

The housing surface 15 includes a first side 11 and a second side 12. The first side 11 is perpendicular to the second side 12. The first side 11 corresponds to the first section 21. The second side 12 corresponds to the second section 22.

At least a portion of the fourth section 24 corresponds to the housing surface 15 of the metal housing 10.

Figure 3:
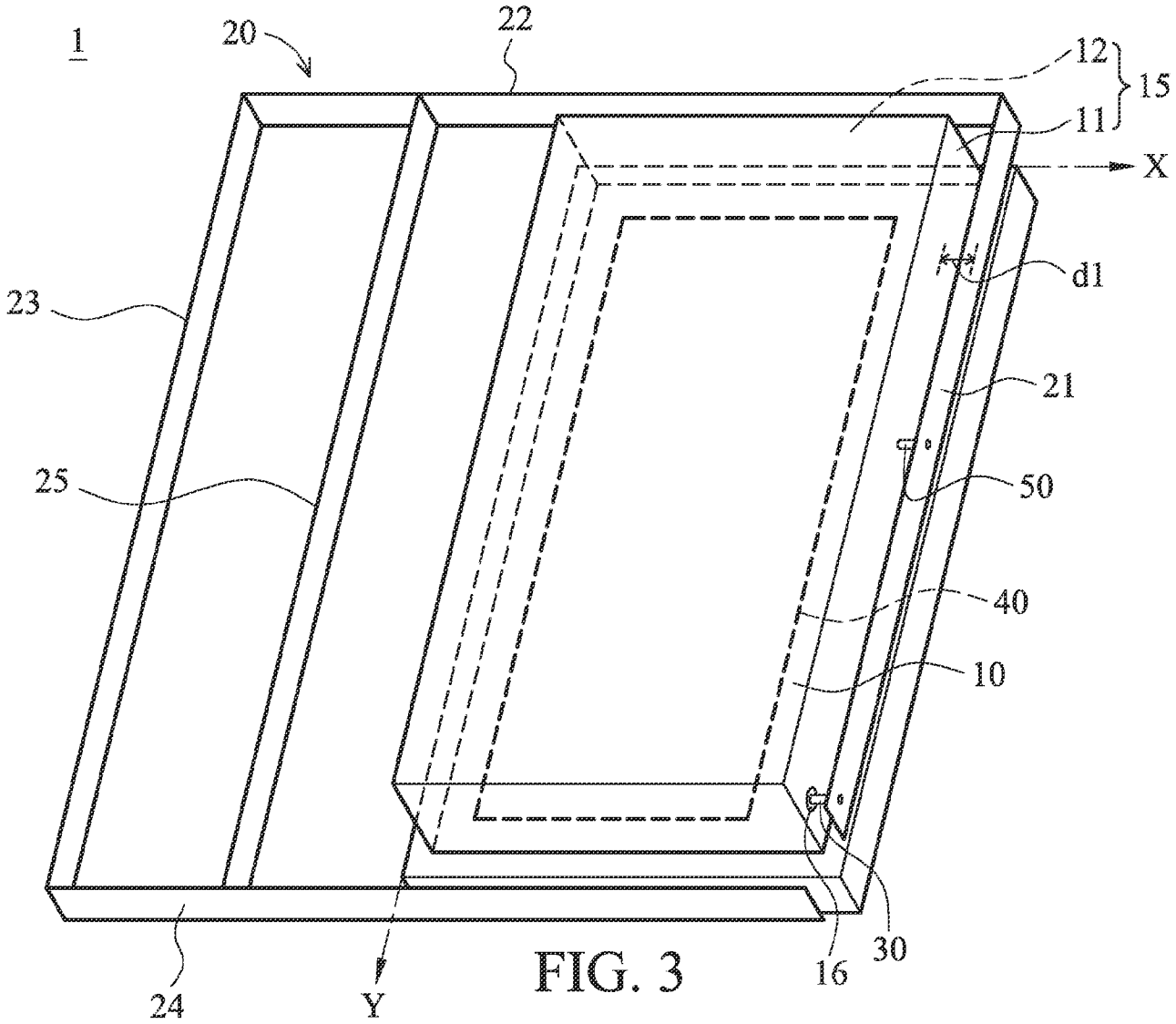
FIG. 3 shows an antenna module of another embodiment of the invention.

With reference to FIG. 3, in an embodiment of the invention, the antenna module 1 further comprises a ground conductor 50. The ground conductor 50 connects the housing surface 15 to the radiator 20.

Figure 2:
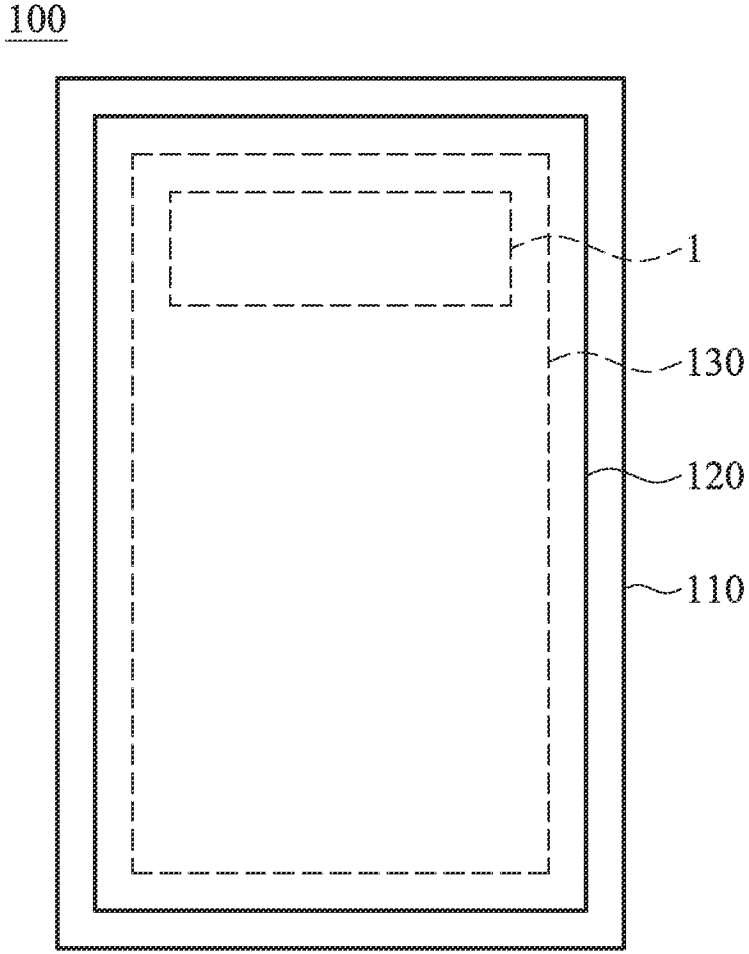
FIG. 2 shows an electronic device of an embodiment of the invention.

FIG. 2 shows an electronic device 100 of an embodiment of the invention, including a device housing 110, a control interface 120, a circuit board 130 and the antenna module 1 mentioned above. The control interface 120 is disposed on the device housing 110. The circuit board 130 is disposed in the device housing 110, and is electrically connected thereto. The antenna module 1 is disposed in the device housing 110, and is located on the circuit board 130. The electronic device 100 can be a cell phone, tablet personal computer or other portable electronic devices. The control interface 120 can be a touch panel or other control interfaces.

The embodiment of the invention provides an antenna module with a simple structure, quasi-isotropic radiation pattern, increased gain in a predetermined direction, and an improved traveling wave radiating mechanism.

In the embodiment of the invention, the feed point of the feed conductor connected to the radiator can be changed. The ground point of the ground conductor connected to the radiator can be changed. The embodiment disclosed above does not restrict the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna module, comprising:

a metal housing, comprising a housing surface and a through hole;

a radiator, surrounding the metal housing; and a feed conductor, wherein the feed conductor connects the radiator to an inner circuit inside the metal housing via the through hole; and a ground conductor, connected to the housing surface and the radiator, wherein the radiator includes a first section, a second section and a third section, and the first section is connected to an end of the second section, the third section is connected to another end of the second section, the second section is perpendicular to the first section and the third section, and the first section is parallel to the third section, wherein the first section and the second section extend along the housing surface of the metal housing, and the first section and the second section is kept at a distance away from the housing surface, wherein the feed conductor is connected an end of the first section, and the second section is connected to another end of the first section, wherein the metal housing, the feed conductor and the ground conductor are substantially located in a space formed by the first section, the second section and the third section, wherein the first section, the second section and the third section form a U-shaped structure, wherein the radiator further comprises a fourth section, and the fourth section is connected to an end of the third section, and the fourth section is perpendicular to the third section, wherein the radiator further comprises a fifth section, and an end of the fifth section is connected to the second section, another end of the fifth section is connected to the fourth section, and the fifth section is located between the third section and the metal housing.

2. The antenna module as claimed in claim 1, wherein the housing surface comprises a first side, a second side and a third side, the first side faces the radiator, the first side is adjacent to the second side, the second side adjacent to the third side, the radiator comprises a longitudinal sheet with a length, a height and a thickness, the length is greater than the height, the height is much greater than the thickness, the longitudinal sheet extends along the length direction surrounding the first side, the second side and the third side.

3. The antenna module as claimed in claim 1, wherein the housing surface comprises a first side and a second side, and the first side is perpendicular to the second side, the first side corresponds to the first section, and the second side corresponds to the second section.

4. The antenna module as claimed in claim 1, wherein at least a portion of the fourth section corresponds to the housing surface of the metal housing.

5. An electronic device, comprising:

a device housing;

a control interface, disposed on the device housing;

a circuit board, disposed in the device housing; and an antenna module, disposed in the device housing and located on the circuit board, comprising:

a metal housing, comprising a housing surface and a through hole;

a radiator, surrounding the metal housing; and a feed conductor, wherein the feed conductor connects the radiator to an inner circuit inside the metal housing via the through hole; and a ground conductor, connected to the housing surface and the radiator, wherein the radiator includes a first section, a second section and a third section, and the first section is connected to an end of the second section, the third section is connected to another end of the second section, the second section is perpendicular to the first section and the third section, and the first section is parallel to the third section, wherein the first section and the second section extend along the housing surface of the metal housing, and the first section and the second section is kept at a distance away from the housing surface, wherein the feed conductor is connected an end of the first section, and the second section is connected to another end of the first section, wherein the metal housing, the feed conductor and the ground conductor are substantially located in a space formed by the first section, the second section and the third section, wherein the first section, the second section and the third section form a U-shaped structure, wherein the radiator further comprises a fourth section, and the fourth section is connected to an end of the third section, and the fourth section is perpendicular to the third section, wherein the radiator further comprises a fifth section, and an end of the fifth section is connected to the second section, another end of the fifth section is connected to the fourth section, and the fifth section is located between the third section and the metal housing.

6. The electronic device as claimed in claim 5, wherein the housing surface comprises a first side, a second side and a third side, the first side faces the radiator, the first side is adjacent to the second side, the second side adjacent to the third side, the radiator comprises a longitudinal sheet with a length, a height and a thickness, the length is greater than the height, the height is much greater than the thickness, the longitudinal sheet extends along the length direction surrounding the first side, the second side and the third side.

7. The electronic device as claimed in claim 5, wherein the housing surface comprises a first side and a second side, and the first side is perpendicular to the second side, the first side corresponds to the first section, and the second side corresponds to the second section.

8. The electronic device as claimed in claim 5, wherein at least a portion of the fourth section corresponds to the housing surface of the metal housing.

* * * * *